US005363899A

United States Patent [19]

Takagi et al.

[11] Patent Number: 5,363,899

[45] Date of Patent: Nov. 15, 1994

[54] METHOD OF DISCRIMINATING QUALITY OF DIE-CAST ARTICLE AND DIE-CASTING PROCESS USING SAME

[75] Inventors: Hiromi Takagi; Fumitaka Takehisa, both of Anjo; Mitsuyoshi Yokoi, Takahama, all of Japan

[73] Assignee: Nippondenso Co., Ltd., Kariya, Japan

[21] Appl. No.: 51,269

[22] Filed: Apr. 23, 1993

Related U.S. Application Data

[63] Continuation of Ser. No. 774,110, Oct. 15, 1991, abandoned.

[30] Foreign Application Priority Data

Oct. 15, 1990 [JP] Japan ..... 2-273197
Nov. 9, 1990 [JP] Japan ..... 2-302528

[51] Int. Cl.[5] ..... B22D 17/32

[52] U.S. Cl. ..... 164/4.1; 164/457; 164/113

[58] Field of Search ..... 164/4.1, 457, 458, 113, 164/150.1, 151, 151.1, 151.2, 151.4, 154.1, 155.4, 155.5, 155.6

[56] References Cited

U.S. PATENT DOCUMENTS 3,006,043 10/1961 Goldhammer .
4,446,907 5/1984 Suzuki et al. .
4,469,164 9/1984 Ishikawa et al. .
4,497,359 2/1985 Suzuki et al. .
4,559,991 12/1985 Motomura et al. .
4,844,146 7/1989 Kikuchi .
4,874,032 10/1989 Hatamura .
4,932,458 6/1990 Iwamoto et al. .

FOREIGN PATENT DOCUMENTS 0065841 12/1982 European Pat. Off. .
0262519 4/1988 European Pat. Off. .
1269966 11/1986 Japan .
59-013942 4/1988 Japan .
63-072467 4/1988 Japan .

OTHER PUBLICATIONS

Patent Abtracts of Japan, vol. 12, No. 294, Aug. 1988, 61-216824 published Apr. 1988 (English Abstract).
JP A-59-13942, Jan. 1984 English Abstract.
Metal Handbook, 9th ed, vol. 15, pp. 294-295.

*Primary Examiner*—P. Austin Bradley
*Assistant Examiner*—Erik R. Puknys
*Attorney, Agent, or Firm*—Cushman, Darby & Cushman

[57] ABSTRACT

A method of discriminating the quality of die-cast articles when casting an article by pressurizing and filling a molten metal into a die through an injecting sleeve using an injecting plunger. The method has the steps of measuring at least one of the operational parameters of a die temperature, a gas pressure in a die cavity, a molten metal pressure in a die cavity, an injecting sleeve temperature, an injecting plunger travel speed, and an injection plunger displacement; and discriminating the quality of a die-cast article by comparing the measured parameter value with a reference value determined on the basis of a predetermined interrelationship between the operational parameter and an allowance limit of the amount of a casting defect.

7 Claims, 18 Drawing Sheets

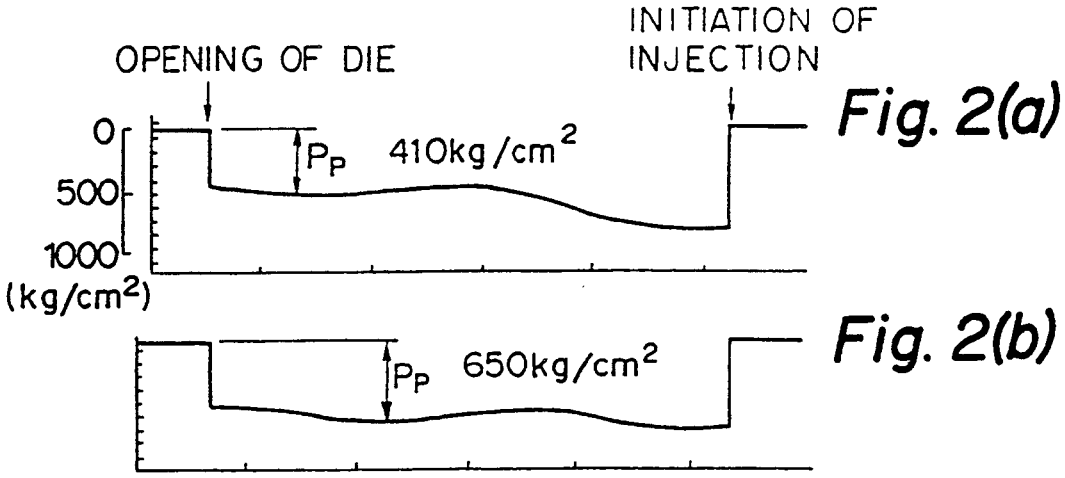
Fig. 2(a)
Fig. 2(b)
Fig. 3
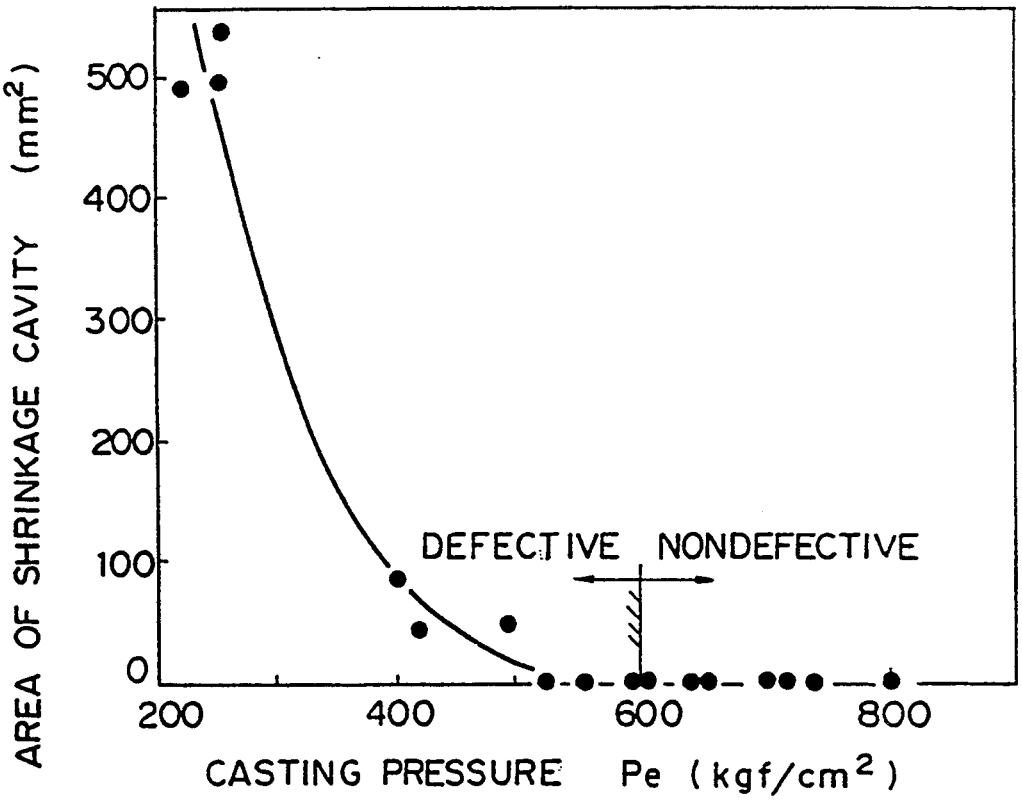

METHOD OF DISCRIMINATING QUALITY OF DIE-CAST ARTICLE AND DIE-CASTING PROCESS USING SAME

This is a continuation of application Ser. No. 07/774,110, filed on Oct. 15, 1991, which was abandoned upon the filing hereof.

BACKGROUND OF THE INVENTION

1. Field of the Invention

The present invention relates to a method of discriminating the quality of die-cast articles, a method of stratifying die-cast articles by quality, and a die-casting process utilizing the method.

2. Description of the Related Art

In the casting field, a higher quality of cast articles are required and it is desired that individual articles are nondefective.

In conventional die-casting, phenomena occurring during the casting process are not completely understood and casting defects cannot be detected within the stage of casting.

Japanese Unexamined Patent Publication (Kokai) No. 63-72467 disclosed a process in which a pressure sensor and a temperature sensor are disposed on a die and measured values therefrom are compared with a preset reference value to control the casting condition.

The above-mentioned conventional process, however, has drawbacks in that it cannot discriminate the product quality in terms of an inclusion of broken chilled layer and a gas inclusion, which exert a great influence upon the quality of a die-cast article, and in that a shrinkage cavity defect cannot be strictly discriminated because of lack of a proper reference value.

In the pressure die-casting process, a molten metal is introduced into a die cavity of a die through an injecting port of the die, the introduced molten metal is primary-pressurized in the die cavity with a pressure through the injecting port and then additionally secondary-pressurized in the die cavity with a pressure through a pressurizing port other than the injecting port, to provide a cast article having a high density.

Japanese Examined Patent Publication (Kokoku) No. 59-13942 discloses a die-casting apparatus having an improved constitution of the pressurization mechanism to ensure the pressurization effect and satisfy the requirement for a high quality die cast article.

With the conventional apparatus, however, the pressurization effect varies when the casting conditions vary, with the result that a shrinkage cavity occurs and the allowance for machining fluctuates at the portion directly subjected to the pressure upon pressurization.

SUMMARY OF THE INVENTION

An object of the present invention is to provide a method of discriminating the quality of die-cast articles, particularly the occurrence of casting defects within the stage of casting, by measuring the molten metal pressure in a die cavity, the injection speed, the die temperature, and other casting conditions.

Another object of the present invention is to provide a method of stratifying the quality of die-cast articles, utilizing the discrimination method.

A further object of the present invention is to provide a die-casting process using the discrimination and stratification methods.

To achieve the above object according to the present invention, there is provided a method of discriminating the quality of die-cast articles when casting an article by pressurizing and filling a molten metal into a die through an injecting sleeve by means of an injecting plunger, said method comprising the steps of:

measuring at least one of the operational parameters of a die temperature, a gas pressure in die cavity, a molten metal pressure in die cavity, an injecting sleeve temperature, an injecting plunger travel speed, and an injection plunger displacement; and discriminating the quality of a die-cast article by comparing said measured parameter value with a reference value determined on the basis of a predetermined interrelationship between said operational parameter and an allowance limit of the casting defects.

According to the present invention, there is also provided a method of stratifying die-cast articles into groups, when casting an article by pressurizing and filling a molten metal into a die through an injecting sleeve by means of an injecting plunger, said method comprising the steps of:

measuring at least one of the operational parameters of a die temperature, a gas pressure in die cavity, a molten metal pressure in die cavity, an injecting sleeve temperature, an injecting plunger travel speed, and an injection plunger displacement; and discriminating the quality of a die-cast article by comparing said measured parameter value with a reference value determined on the basis of a predetermined interrelationship between said operational parameter and an allowance limit of the casting defects, to stratify the die-cast articles into a group of nondefective articles and groups of defective articles including different kinds of defects, within the stage of casting.

According to the present invention, there is also provided a pressure die-casting process comprising the steps of:

introducing a molten metal into a die cavity of a die through an injecting port of the die;

primary-pressurizing said introduced molten metal in said die cavity with a pressure through said injecting port;

additionally secondary-pressurizing said molten metal in said die cavity with a pressure through a pressurizing port other than said injecting port;

predetermining a relationship between a first group of operational parameters of a die temperature and a duration of said primary pressurization and a second group of operational parameters of a initiation time and speed of said secondary pressurization, to provide an optimum relationship for preventing shrinkage cavity of a cast product;

measuring a die temperature and a duration of said primary pressurization;

determining preset values of a secondary pressurization initiation time and a secondary pressurization speed on the basis of said measured values of the die temperature and the duration of primary pressurization; and effecting said secondary pressurization with said preset values of the secondary pressurization initiation time and the secondary pressurization speed.

According to the present invention, there is also provided a pressure die-casting process comprising the steps of:

introducing a molten metal into a die cavity of a die through an injecting port of the die;

primary-pressurizing said introduced molten metal in said die cavity with a pressure through said injecting port;

additionally secondary-pressurizing said molten metal in said die cavity with a pressure through a pressurizing port other than said injecting port;

predetermining a change of a molten metal pressure in said die cavity as a function of an elapsed time, to provide a reference wave profile for preventing a shrinkage cavity in a cast product;

measuring a change of a molten metal pressure in said die cavity, to provide a measured wave profile;

comparing said measured wave profile with said reference wave profile; and resetting said secondary pressurization initiation time and said secondary pressurization speed on a basis of said comparison.

According to the present invention, there is also provided a method of discriminating the quality of articles cast by a pressure die-casting process comprising the steps of introducing a molten metal into a die cavity of a die through an injecting port of the die; primary-pressurizing said introduced molten metal in said die cavity with a pressure through said injecting port; and additionally secondary-pressurizing said molten metal in said die cavity with a pressure through a pressurizing port other than said injecting port; said method comprising:

predetermining a change of a molten metal pressure in said die cavity as a function of an elapsed time, to provide a reference wave profile for preventing a shrinkage cavity in a cast product;

measuring a change of a molten metal pressure in said die cavity, to provide a measured wave profile;

comparing said measured wave profile with said reference wave profile; and judging the quality of an article cast by said casting on a basis of said comparison.

BRIEF DESCRIPTION OF THE DRAWINGS

FIGS. 2(*ia*) and 2(*b*) show charts of the measured casting pressures;

FIG. 3 is a graph showing a relationship between the casting pressure and the shrinkage cavity area;

DESCRIPTION OF THE PREFERRED EMBODIMENTS

According to the present invention, nondefective cast articles can be strictly and rapidly discriminated within the stage of casting of the article by: predetermining the interrelationship between the fraction occurrence of a casting defect and at least one of the operational parameters of a die temperature, a gas pressure in die cavity, a molten metal pressure in die cavity, an injecting sleeve temperature, an injecting plunger travel speed, and an injection plunger displacement; presetting a reference value of an allowable fraction occurrence of the casting defect; measuring the operational parameter during an actual casting; and comparing said measured parameter value with the predetermined reference value.

Preferably, at least one of the following relationships (1) to (4) are used as the above-mentioned interrelationship;

(1) a relationship between the operational parameters of the die temperature, the injection sleeve temperature, the injection plunger travel speed, and the injection plunger displacement and the allowance limit of the inclusion proportion of broken chilled layers;

(2) a relationship between the molten metal pressure in die cavity and an amount of shrinkage cavity;

(3) a relationship between the operational parameter of the gas pressure in die cavity and an amount of water-leakage-induced defects and gas inclusion; and (4) a relationship between the operational parameter of the die temperature and the fraction occurrence of misrun.

The present invention will be described in more detail by way of examples and with reference to the attached drawings.

EXAMPLE 1

Figure 1:
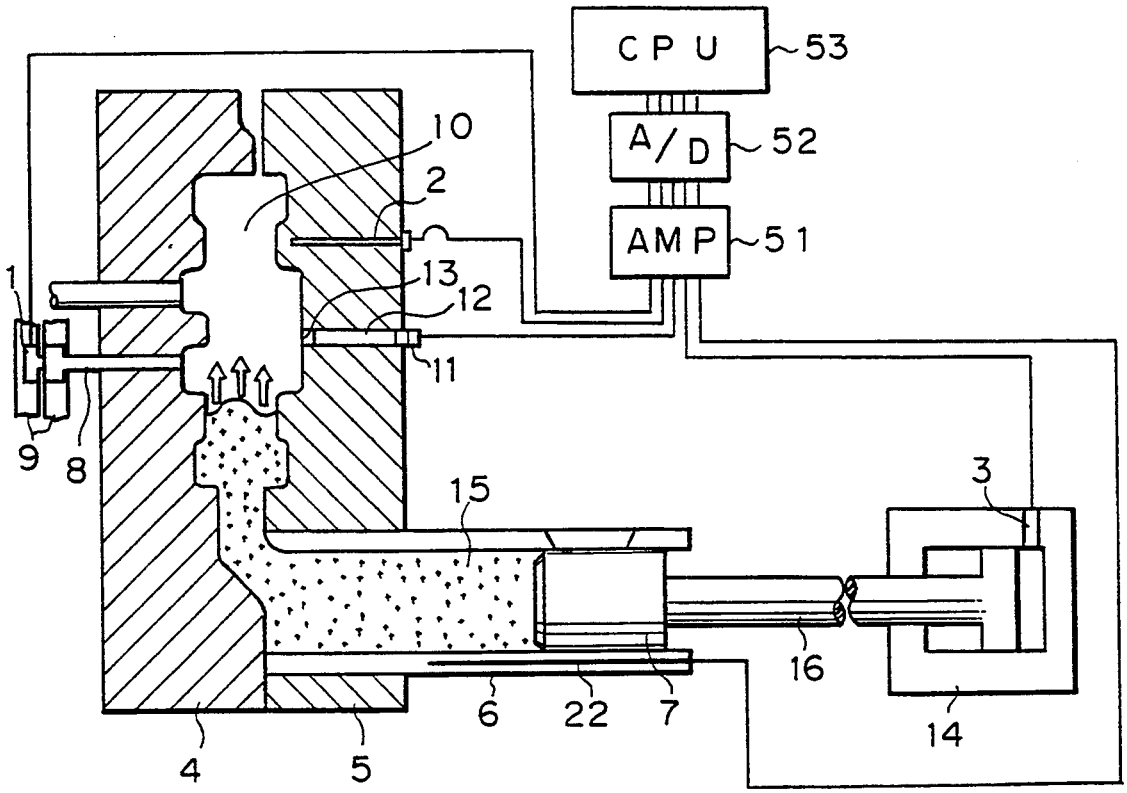
FIG. 1 shows an arrangement for carrying out a pressure die-casting according to the present invention, in partial sectional view.

FIG. 1 shows an arrangement of a die-casting machine for carrying out the quality discrimination method.

A movable die 4 and a fixed die 5 compose a casting die having a die cavity 10 containing a molten metal 15 whose pressurized condition is detected by a pressure sensor 1 disposed on an ejector plate 9 and at an end face of an ejector pin 8 which pushes out a cast product. The pressure sensor 1 measures a casting pressure or a pressure applied on the molten metal in the die cavity 10 in terms of a compressive force applied on the ejector pin 8. In the shown example, the pressure sensor 1 is a strain-gauge type having a globular top for sensing a normal pressure. The pressure sensor may be disposed at a portion communicating with a die cavity 10 and not constrained by the die to ensure free transfer of a normal load. Preferably, the pressure sensor 1 is disposed in a manner such that the pressure of molten metal is measured at the site where the metal is finally solidified. The shown pressure sensor 1 is disposed on the end face of the ejector pin 8, which travels in a sliding manner upon every shots of casting, in due consideration of a frictional drag due to a fin and a clogged substance.

A pressure sensor 11 is disposed on a pressure path 12 communicating with the die cavity 10, for measuring a pressure of gas (air, mist, etc.) in the die cavity 10 upon filling the molten metal therein.

The type of pressure sensor 11 is not limited but may be a strain gauge type, a diaphragm type, etc., although the temperature condition of the dies 4 and 5 need be considered.

A Chromel-Almel (CA) thermocouple is used as temperature sensors 2 and 22 for measuring the die temperature and the injection sleeve temperature, respectively, because of the measuring range from room temperature to 700° C. The CA-thermocouple 2 is inserted in a hole extending from the die surface toward a measuring point of the die. The thermocouple 2 is held by a spring to ensure close contact of the tip of the thermocouple 2 with the die at the measuring point.

An injection plunger rod 16 has many pulse-shaped grooves arranged thereon, so that the displacement of the rod 16 is detected as a pulse signal by a speed and displacement sensor 3, which is a magnetic head comprising a semiconductor magnetic resistance element. The rod speed is provided by differentiating the displacement by time. Alternatively, a displacement meter of a strain gauge type, a laser type, an ultrasonic type, etc. may be used.

The sensors 1, 11, 2, and 22 are connected to respective A/D converters 52 directly or via amplifiers 51, so that a detected analog signal is converted into a digital signal to be fed to a computer 53.

The present invention utilizes the interrelationship between the operational parameters and the different kinds of casting defects, as summarized in Table 1.

TABLE 1

| Casting defects | Operational parameters |
|---|---|
| Shrinkage cavity | Molten metal pressure in die cavity |
| Water leakage defect | Gas pressure in die cavity |
| Slag inclusion | |
| Inclusion of broken chilled layer | Die temperature<br>Injection plunger travel speed<br>Injection plunger displacement |
| Misrun | Die temperature |

FIGS. 2 (*a*) and 2 (*b*) show practical data of a casting pressure continuously measured by the above-described pressure sensor 1, for two typical cast articles having a shrinkage cavity (a) and no shrinkage cavity (b). As seen in the figure, the casting pressure varies during one shot of casting. A peak pressure, Pp, a molten metal pressure in the die cavity, Pe, or other characteristic pressures detected after an injection and before a die opening are used for comparison with a reference pressure value predetermined by an experiment, to judge the presence or absence of a shrinkage cavity for the cast article obtained by a particular shot of casting. FIG. 3 shows a set of data obtained in a preliminary experiment conducted for presetting a reference pressure value, in which the shrinkage cavity area is plotted against the molten metal pressure in die cavity, Pe measured by the sensor 1, as a representative of the casting pressure. From this result, it can be judged that individual cast articles do not have a shrinkage cavity when the molten metal pressure in the die cavity is not less than 600 kgf/cm$^2$.

Figure 4:
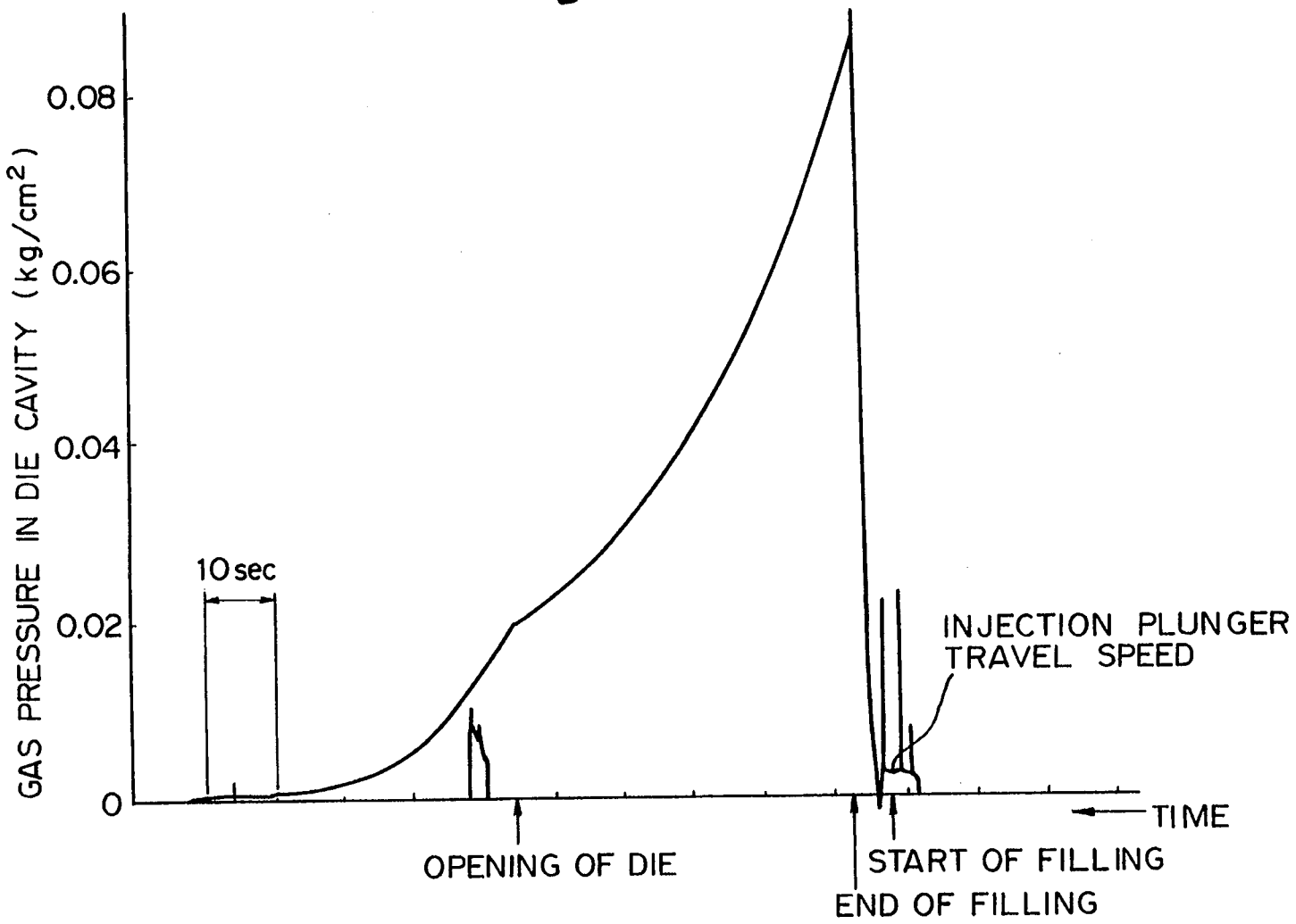
FIG. 4 shows a chart of the measured gas pressure in a die cavity.
Figure 5:
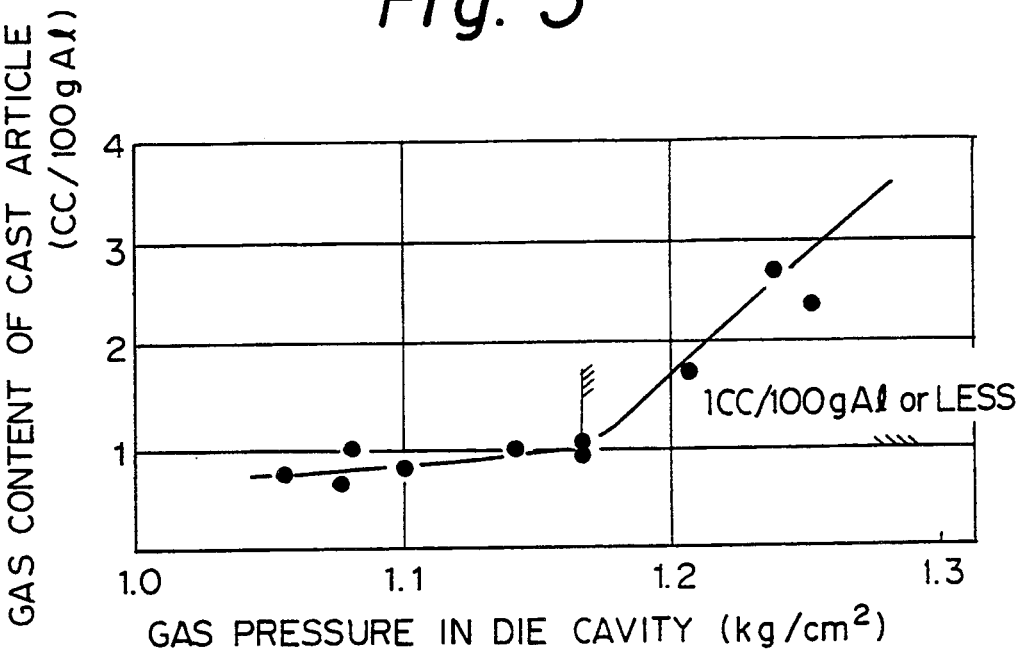
FIG. 5 is a graph showing a relationship between the gas pressure in a die cavity and the gas amount of a cast product.

FIG. 4 exemplifies a datum of the gas pressure in die cavity 10 continuously measured by the pressure sensor 11 during one shot of casting initiated by the initiation of the operation of the injection plunger 7, i.e., the initiation of filling the die cavity 10 with a molten metal, and terminated by the die opening. The gas pressure in the die cavity, Pg measured by the sensor 11, is compared with a reference value preliminarily and experimentally obtained as a critical limit with respect to occurrence of a gas inclusion and water leakage-induced defects such as cavities, blister, surface wrinkles, cold shut, to judge whether or not these defects are present in the particular article cast by that casting shot. FIG. 5 shows the result of a preliminary experiment conducted for determining a reference value. The variation of the gas content of cast article is shown with respect to a gas pressure in die cavity, Pg. From this result, it can be judged that a particular article does not have a gas inclusion (entrained and embedded gas) and a water leakage-induced defect, when the gas pressure in die cavity (Pg) is not more than 1.17 kg/cm$^2$ during the casting of that article. The contents of a gas inclusion and a water leakage-induced defect are proportional to the gas content of a cast article. Note that the gas pressure is expressed in terms of a relative pressure in FIG. 4, in which the atmospheric pressure is taken as 0, and an absolute pressure in FIG. 5, in which the atmospheric pressure is taken as 1.

Figure 6:
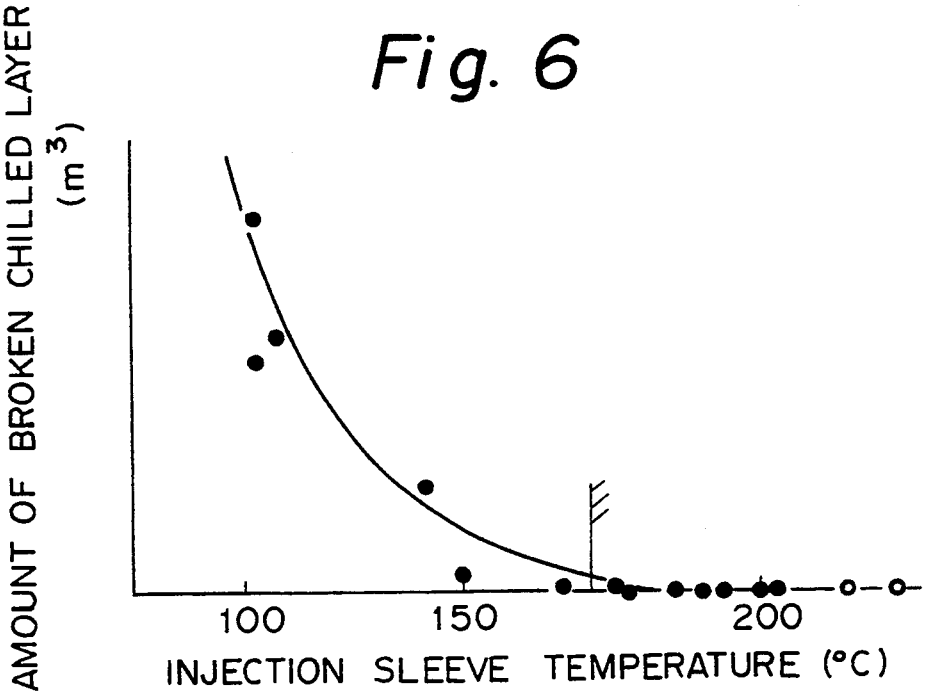
FIG. 6 is a graph showing a relationship between the die temperature and the amount of broken chilled layer.

It has been found that a broken chilled layer, generated at the inner surface of an injection sleeve 6, remarkably lowers the article strength when excessively present in an article. Generally, the injection sleeve temperature and the amount of generated broken chilled layer have an interrelationship therebetween as shown in FIG. 6, and therefore, the latter can be estimated from the former. From this result, it can be judged that there is no broken chilled layer if the injection sleeve temperature is not lower than 170° C.

Figure 7:
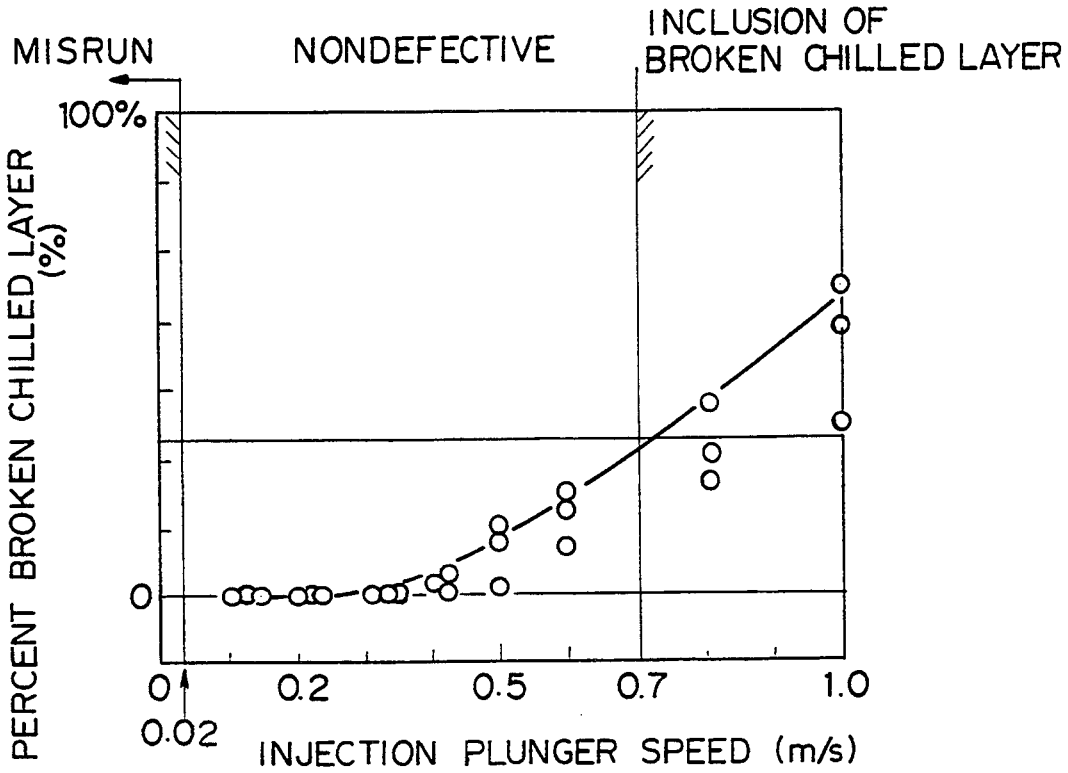
FIG. 7 is a graph showing a relationship between the travel speed of injection plunger and the amount of broken chilled layer.
Figure 8:
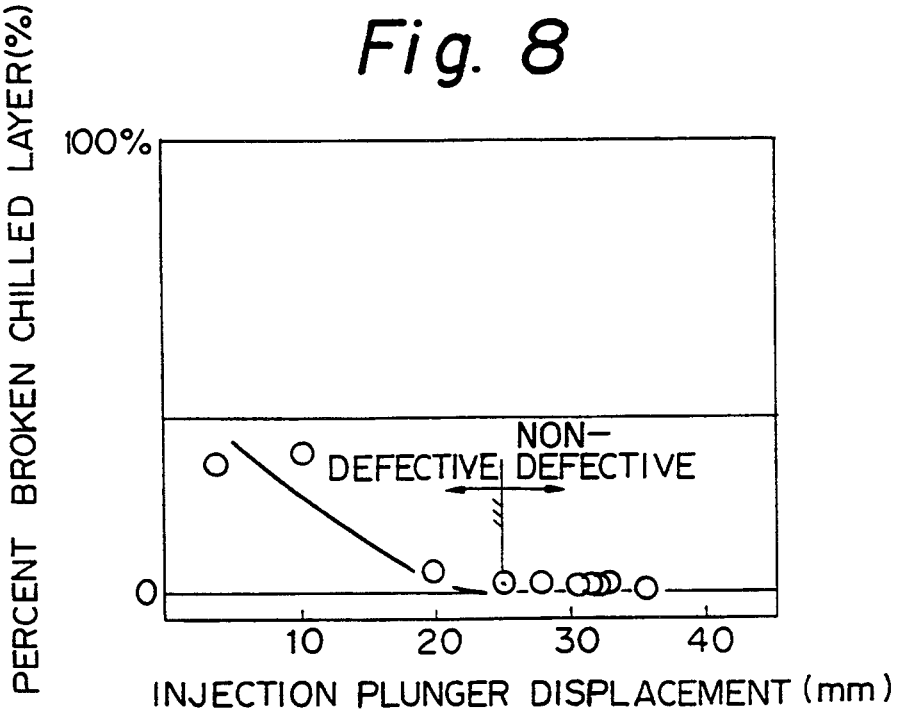
FIG. 8 is a graph showing the displacement of injection plunger and the amount of broken chilled layer.
Figure 11:
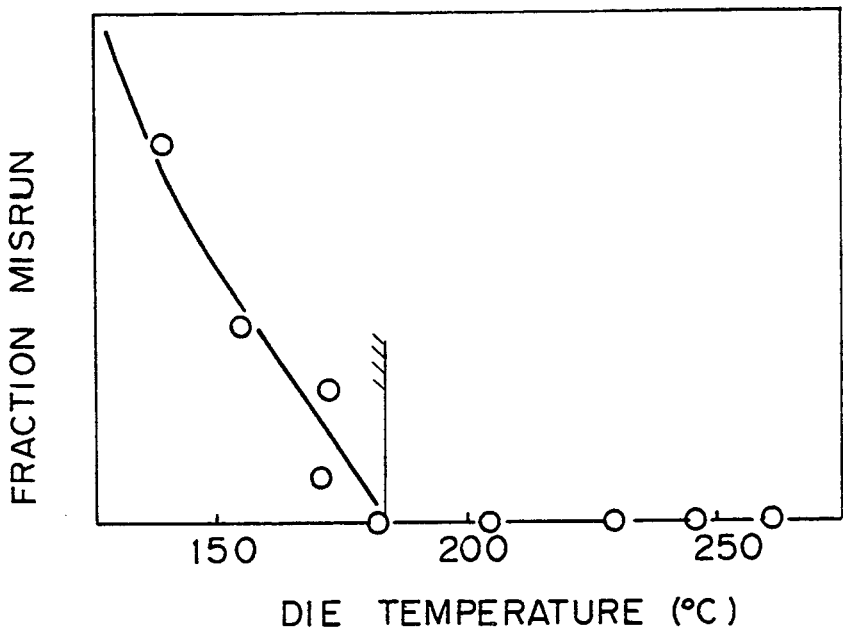
FIG. 11 is a graph showing a relationship between the die temperature and the fraction misrun.

The fraction occurrence of a misrun has a relationship with the die temperature as shown in FIG. 11, from which it is seen that no misrun occurs when the die temperature is not lower than 180° C. As shown in FIGS. 7 and 8, the fraction broken chilled layer has a relationship with the travel speed and the displacement of an injection plunger, measured by a speed and displacement sensor 3. It is seen from these relationships that the fraction broken chilled layer falls within an allowance limit when the injection plunger travel speed is not higher than 0.7 m/s, for example. The injection plunger travel speed, however, should be not less than 0.02 m/s to prevent the occurrence of a misrun, which occurs when the injection plunger travel speed is excessively low.

By using at least one of the above-described operational parameters, presence and absence of the corresponding casting defects can be judged as listed in Table 1. Preferably, a plurality of operational parameters are adopted for judging the corresponding casting defects, and most preferably, all of the listed operational parameters are used for judging all of the listed casting defects.

Preferably, the casting conditions are measured for the entire process of one casting shot and the quality of the cast article is judged by comparing a reference value with the measured data, in terms of mean, maximum, minimum, integrated, or differentiated values, for a part of one casting stage or shot. Cast articles discharged from a die-casting machine by means of a not-shown robot or the like are stratified in accordance with the judgment and packed in boxes for forwarding.

Particular values from a set of sequentially measured data of the respective operational parameters are used for judging the quality of a cast article. In the wave profile of the molten metal pressure on a die cavity surface as shown in FIG. 2, a peak value measured after an injection and before a die opening is used for the judgment, although a mean value or the like calculated for the same period may be used instead. In the wave profile of the gas pressure in the die cavity as shown in FIG. 4, a peak value is measured after completion of the filling of a molten metal, although a pressure value measured at any other time in the filling process may be used instead. The die temperature is taken synchronously with a signal indicating that the casting preparation is completed or that the pouring of molten metal is initiated.

Regarding the injection plunger travel speed shown in FIG. 7, an interval mean value is used, although other values such as maximum, minimum, or standard deviation values may be used.

The injection plunger displacement shown in FIG. 8 is a distance the plunger traveled until the filling of molten metal is completed, the position of the plunger at the initiation of the filling being taken as a zero displacement point.

Figure 9:
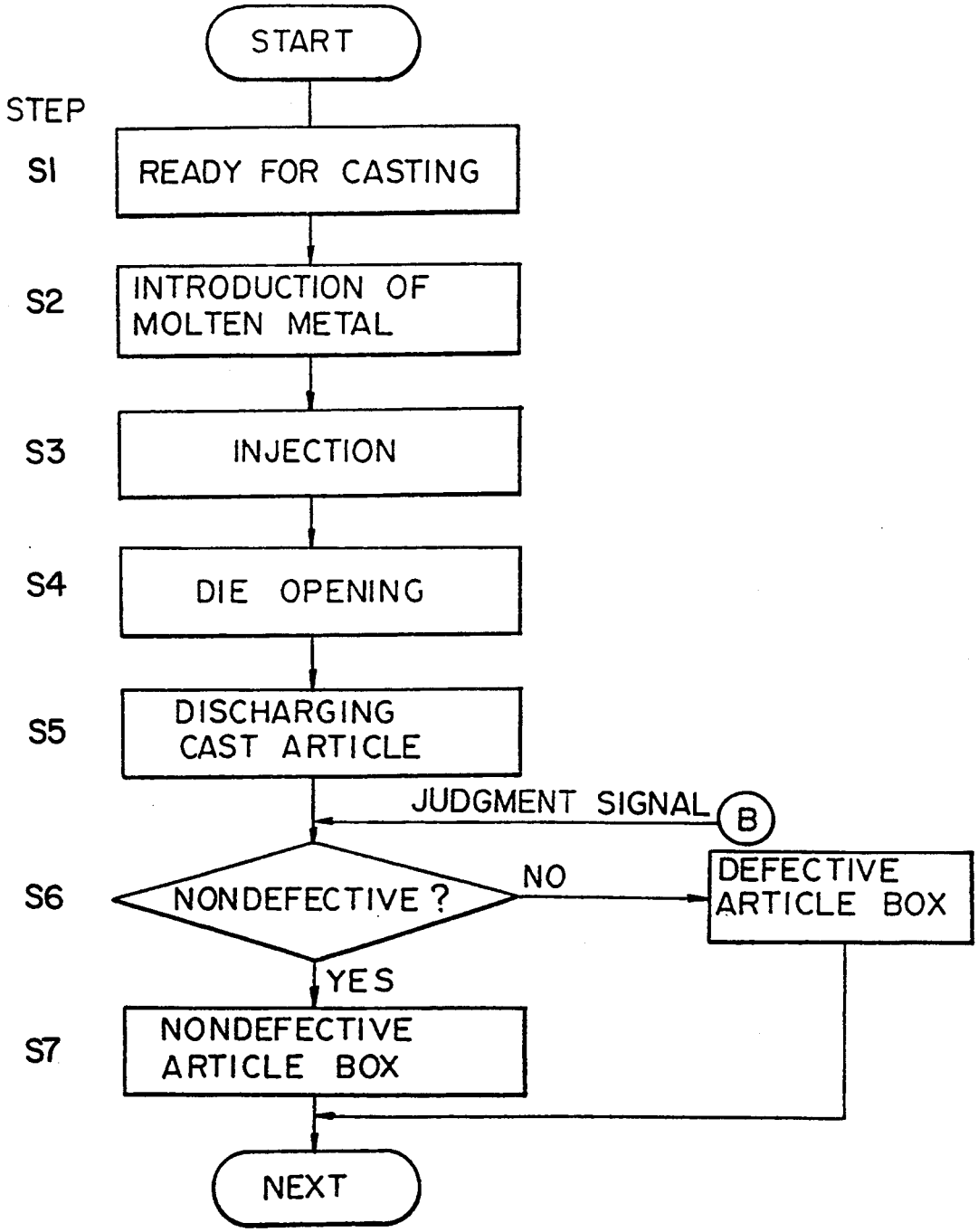
FIG. 9 shows a flowchart of a casting process in which the quality of cast articles is discriminated according to the present invention.

FIG. 9 shows a flowchart of a die-casting process composed of steps S1 to S7, in which the actual casting operation is effected in the stage of steps 2 through 5.

Sample data are taken from the data "A" (FIG. 10) measured in the casting steps S1 to S5 and compared with a reference value preliminarily preset by an experiment, and thereby, the quality of cast articles is judged. This judgment is conducted by a not-shown microcomputer, for example. The thus-obtained judgment signal "B" is fed to step 6, in which the cast article is stratified into any one of nondefective and defective groups. The herein used word "stratification" means discriminating cast articles into nondefective and defective groups and classifying the defective articles in terms of the different kinds of defects.

Figure 10:
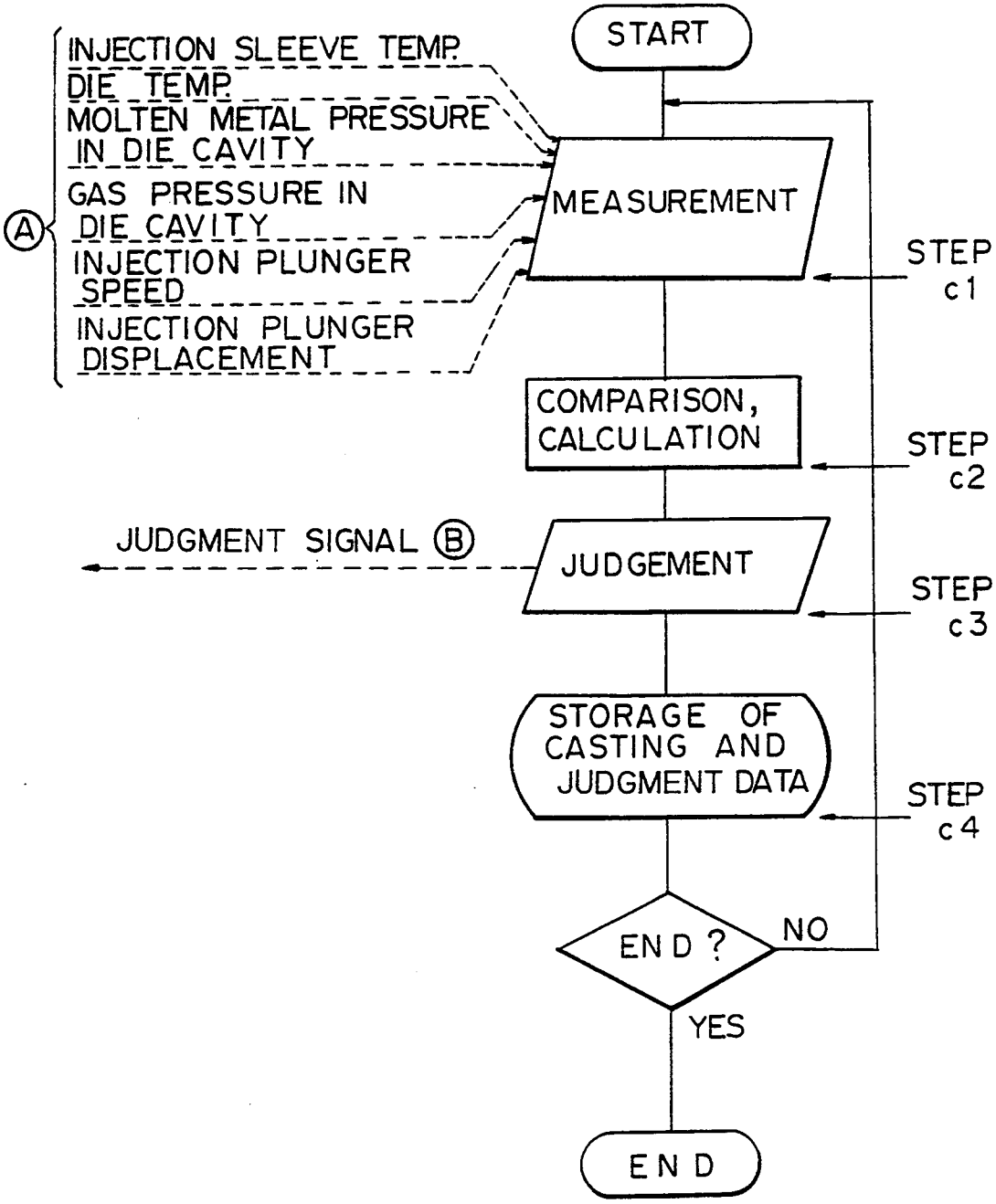
FIG. 10 shows a flowchart of a computer processing for carrying out a discrimination of cast articles according to the present invention.

FIG. 10 shows a sequence of a processing by a computer 53.

Step c1:

The measured data "A" from steps 1 to 5 of FIG. 9 are input to the computer 53.

Step c2:

Data of the operational parameters listed in Table 1 are sampled from the-thus input, measured data and compared with respective reference values. For the casting pressure or the molten metal pressure in the die cavity, a comparison is made to judge whether or not the reference value is satisfied in FIG. 3. Similarly, the comparison is made in FIG. 5 for the gas pressure in die cavity, FIG. 6 for the injection sleeve temperature, FIG. 7 for the injection plunger travel speed, and FIG. 8 for the injection plunger displacement.

Step c3:

When the reference value is not satisfied in step c3, a judgment of "defective" is issued in this step and a signal indicating "nondefective" or "defective" is output to a not-shown robot for stratification.

Step c4:

The measured data of casting conditions and the judgment results are stored.

"Calculation" in step c2 calculates the sample data, such as a peak value for the casting pressure, for example.

As herein described, the present invention measures the casting conditions (operational parameters) during a casting operation, compares the measured value with a predetermined reference value, and thereby discriminates the quality of the cast articles within a casting stage with respect to many casting defects including those that could not be judged conventionally.

EXAMPLE 2

In a modification of Example 1, the pressurization condition is controlled in accordance with the variation of casting conditions, to prevent casting defects, particularly a shrinkage cavity.

Figure 12:
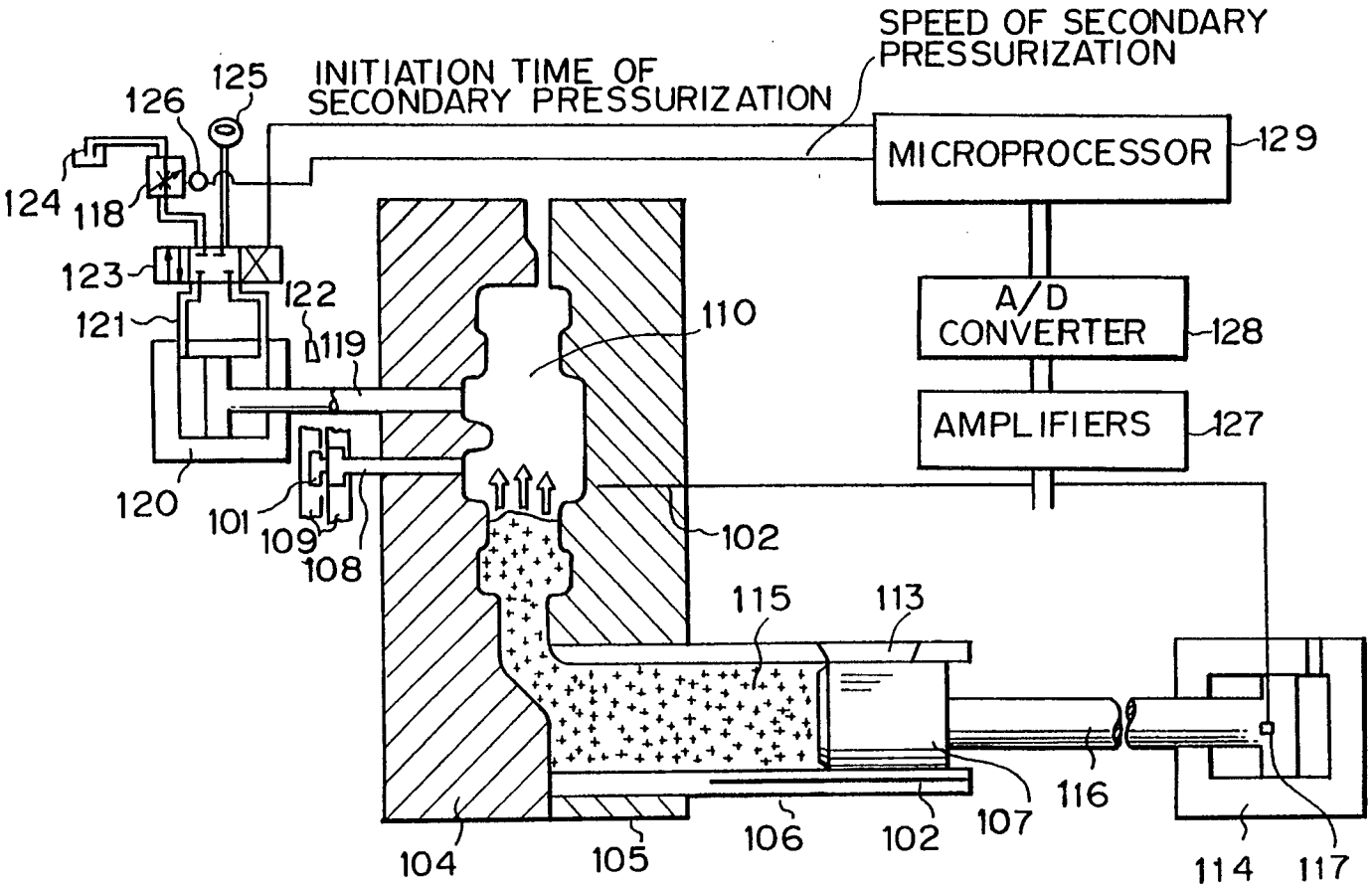
FIG. 12 shows an arrangement for carrying out a pressure die-casting according to the present invention in partial sectional view.

FIG. 12 shows an arrangement for carrying out a pressure die-casting process in a modification of Example 1 according to the present invention.

A movable die 104 and a fixed die 105 compose a casting die to define a die cavity 110 corresponding to the shape of an article to be cast.

A pressure sensor 101 for detecting the pressurized condition of a molten metal in the die cavity 110 is disposed on an ejector plate 109 and in contact with the end face of an ejector pin 108 for ejecting a solidified article, to measure a pressure applied within the die cavity during casting. The pressure sensor 101 is a strain gauge type having a globular top for receiving a normal load or pressure from the ejector pin 108.

A squeeze pin 119 secondary-pressurizes a molten metal in the die cavity 110 to carry out a pressure die-casting as disclosed in Japanese Examined Patent Publication (Kokoku) No. 59-13942. A hydraulic cylinder 120, a hydraulic piping 121, and a flow control valve 118 are provided to drive the squeeze pin 119 for effecting the pressurization.

Figure 13:
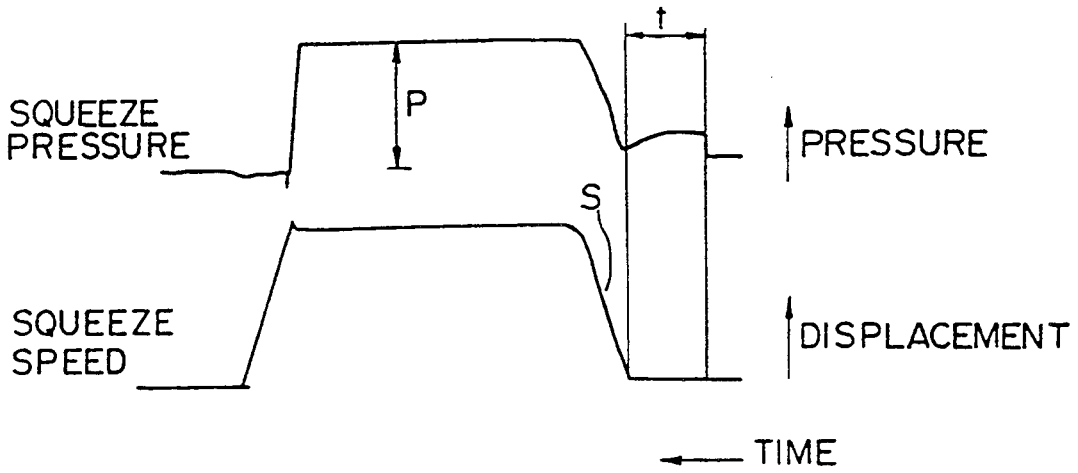
FIG. 13 is a graph showing an operation of a squeeze pin for additionally pressurizing a molten metal in a die cavity.

FIG. 13 shows an operation condition of the squeeze pin 119. Time passes in the direction from right to left in the drawing. The symbol "t" denotes the duration time of primary pressurization, i.e., the time elapsed from the initiation of primary pressurization effected by an injection plunger 107 to the initiation of pressurization effected by the squeeze pin 119. The symbol "P" denotes a pressure under which the squeeze pin 119 operates. The symbol "S" denotes a speed at which the squeeze pin 119 operates. These operational parameters of the squeeze pin 119 are controlled in this Example.

A displacement sensor 122 measures the travel speed and displacement of the squeeze pin 119.

The injection plunger 107 travels in a sliding manner through the injection sleeve 106 to fill a molten metal 115 in the die cavity 110 and applies to the molten metal 115 a pressure transferred through an injection plunger rod 116 and an injection plunger cylinder 114. The molten metal 115 is poured through an molten metal port 113 into the injection sleeve 106, and then, forced by the injection plunger 107 to fill the injection sleeve 106. The pressure applied to the injection plunger 107 is measured by a strain gauge 117 stuck on the injection plunger rod 116.

A temperature sensor 102 measures the die temperature at one or more points.

An electromagnetic valve 123 controls the forward and backward movement of the squeeze cylinder 120. The flow control valve 118 is disposed at the return side of a hydraulic system and is connected to a hydraulic tank 124. The numeral "125" denotes a hydraulic pump. A controller 126 of the flow control valve 118 controls the travel speed of the squeeze pin 119.

The forward movement of the injection plunger 107 forces the molten metal 115 to fill the die cavity 110 defined by the movable die 104 and the fixed die 105 and the filled metal is then primary-pressurized by the same motion of the plunger 107. The solidification shrinkage of the molten metal 115 filled in the die cavity 110 causes a shrinkage cavity in a cast article. To prevent the occurrence of the shrinkage cavity, an additional secondary pressurization is effected by the squeeze pin 119, in addition to the primary pressurization effected by the injection plunger 107.

Figure 14:
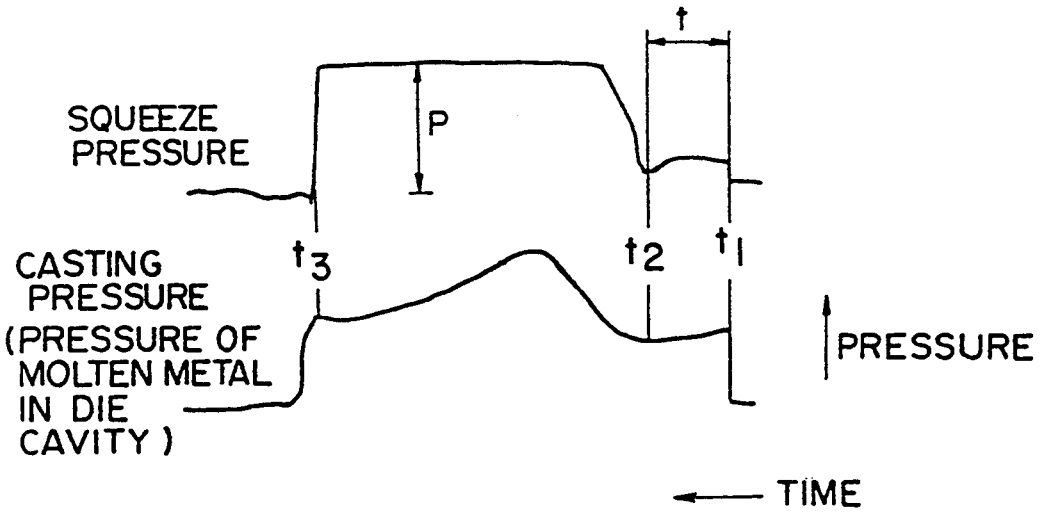
FIG. 14 is a graph showing a pressure wave profile of a squeeze cylinder and a wave profile of a molten metal pressure in a die cavity.

FIG. 14 shows a wave profile of a pressure applied in the squeeze cylinder 120 and a pressurizing force applied in the die cavity 110. Time elapses from right to left in the drawing. At "time t1", the molten metal 115 filled in the die cavity 110 is primary-pressurized by the injection plunger 107. In the process to "time t2" or in the period "t", the molten metal pressure is reduced by solidification shrinkage to a value less than a predetermined wave profile. At "time t2", to compensate the pressure reduction, the squeeze pin 119 operates to transfer the pressurizing force to the die cavity 110. At "time t3", one casting shot is completed, the die opens for discharging a cast article, and the pressure drops.

Figure 15:
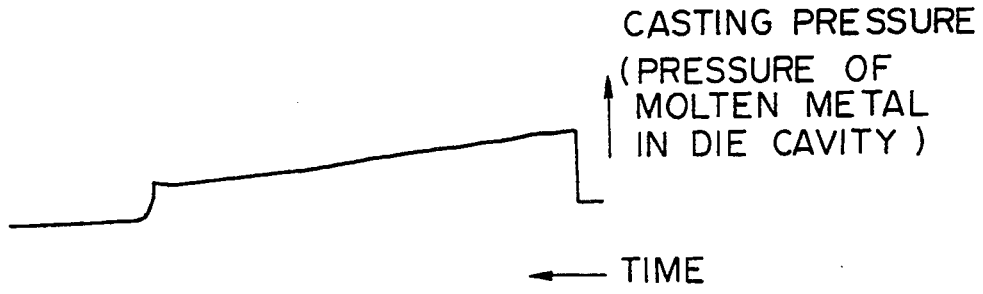
FIG. 15 is a graph schematically illustrating a wave profile of a molten metal pressure in a die cavity.
Figure 16:
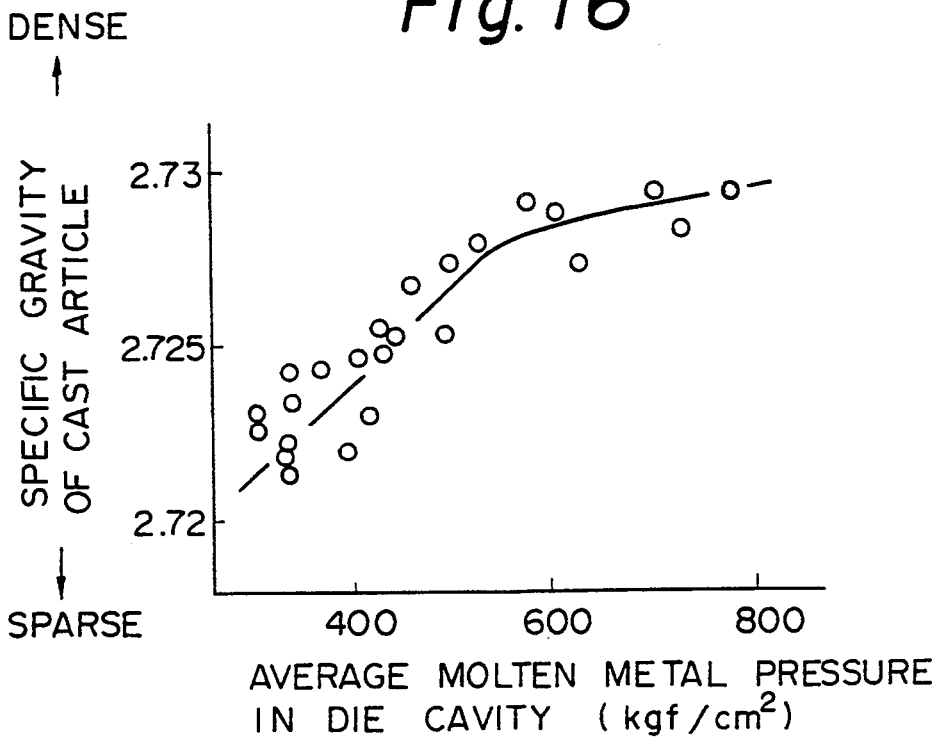
FIG. 16 is a graph showing the change of the specific gravity of cast articles as a function of the average molten metal pressure in a die cavity.

FIG. 15 shows a wave profile of molten metal pressure in the die cavity 110 when the squeeze pressurization force is not sufficiently transferred to the die cavity 110. A larger wave profile has a greater effect of preventing a shrinkage cavity. FIG. 16 shows this in terms of a relationship between the specific gravity of a cast article and the average molten metal pressure in the die cavity, from which it can be seen that the former is reduced as the latter is reduced when the latter is less than a certain value.

This phenomenon is caused by the fact that either the squeeze pressurization (secondary pressurization) or the pressurization by injection plunger (primary pressurization) is inadequate for the solidification of molten metal and insufficient to compensate the pressure reduction due to the solidification shrinkage.

Conventionally, such a phenomenon was not quantitatively but merely qualitatively grasped, and therefore, the casting control based on the phenomenon could not be conducted and the effect of the squeeze pressurization fluctuated, with the result that the occurrence of the shrinkage cavity could not be sufficiently prevented.

According to the present invention, the occurrence of the shrinkage cavity is prevented by detecting the solidification and pressurization conditions in a die cavity during the operation of casting, and based on the detection, conducting a real-time control of the squeeze pressurization.

Figure 17:
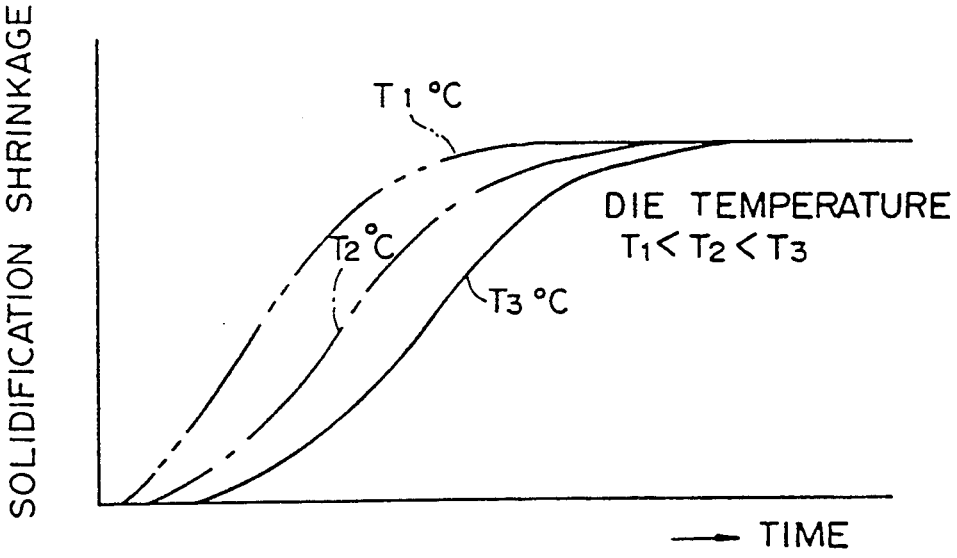
FIG. 17 is a graph showing the solidification speed in terms of a change of the solidification shrinkage with respect to the elapsed time, for different die temperatures.

The solidification speed in a die cavity varies with the die temperature as shown in FIG. 17, i.e., when the die temperature is low, the solidification speed is great, and therefore, the squeeze pressurization speed must be sufficiently high to prevent the shrinkage cavity, because otherwise the solidification is completed before completion of the pressurization. On the other hand, when the die temperature is high, the solidification speed is small, and therefore, the squeeze pressurization speed must be sufficiently small to prevent the shrinkage cavity, because otherwise the pressurization is completed before completion of the solidification to cause a generation of the shrinkage cavity during the subsequent solidification. The higher the solidification speed, the larger the variation of the solidification shrinkage.

Figure 18:
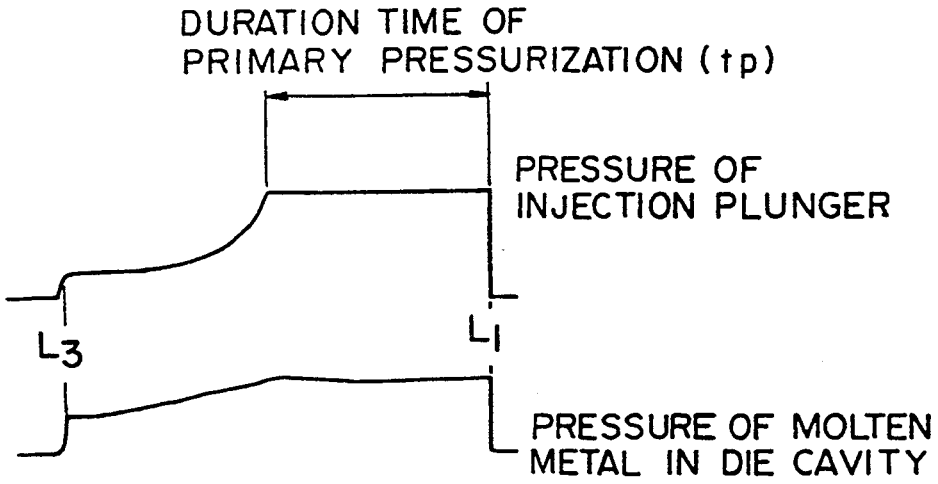
FIG. 18 is a graph showing coincidental reductions of the primary pressure and the molten metal pressure in a die cavity.
Figure 19:
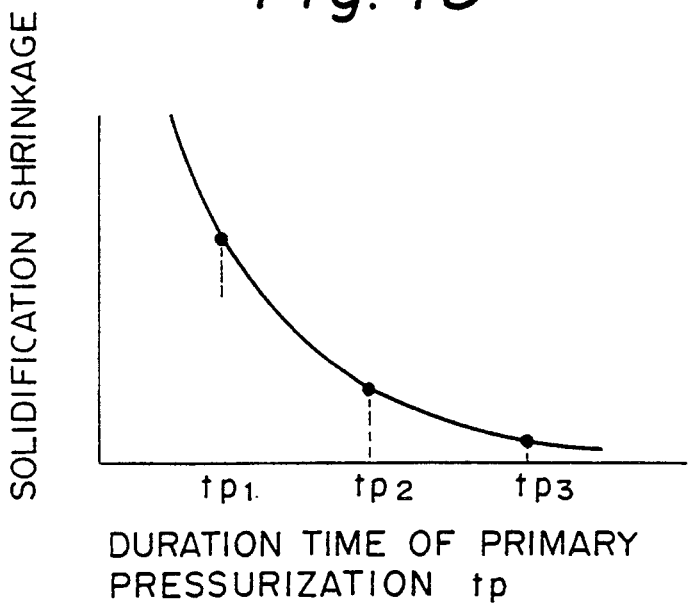
FIG. 19 is a graph showing a change of the shrinkage cavity volume in terms of the solidification shrinkage as a function of the duration time of primary pressurization effected by an injection plunger.
Figure 20:
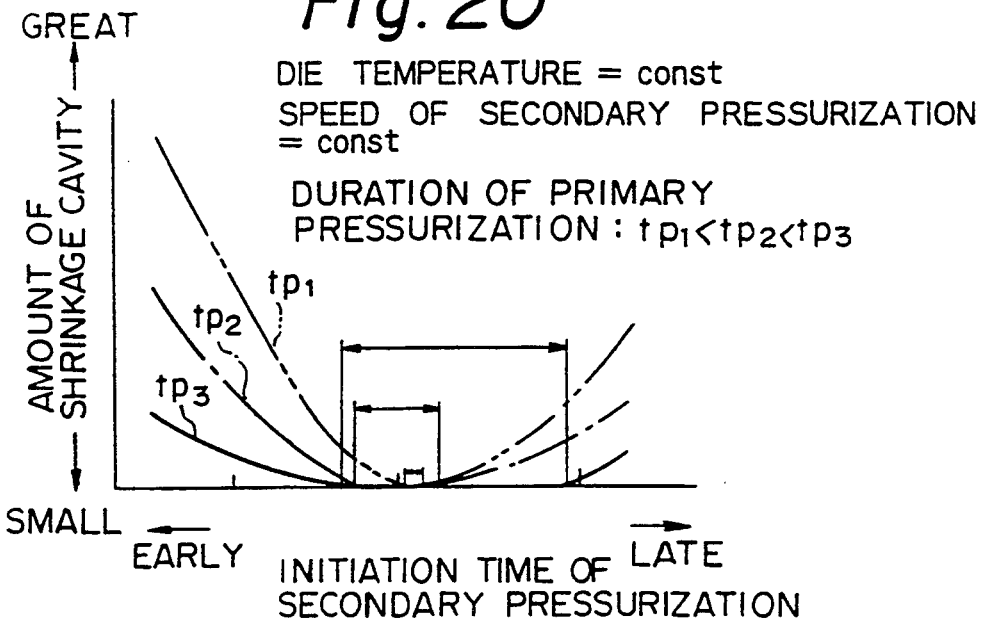
FIG. 20 is a graph showing a relationship between the initiation time of secondary pressurization effected by a squeeze pin or squeeze timing and the amount of shrinkage cavity, for different duration times of the primary pressurization effected by an injection plunger.

The pressure transfer in a die cavity 110 varies with the duration time of primary pressurization by the injection plunger 107. As shown in FIG. 18, when the pressure of the injection plunger 107 is reduced, the pressure in the die cavity 110 is also reduced. FIG. 19 shows a relationship between the duration time, tp, of the primary pressurization by the injection plunger 107 and the amount of shrinkage cavity in terms of the amount of solidification shrinkage. When the primary pressurization duration time is long, the shrinkage cavity amount is small. It should be noted that this relationship must be combined with the initiation time of secondary pressurization, as shown in FIG. 20. Namely, as seen from the drawing, when the secondary pressurization is initiated either too early or too late, a longer duration of the primary pressurization cannot sufficiently reduce the amount of shrinkage cavity.

Figure 21:
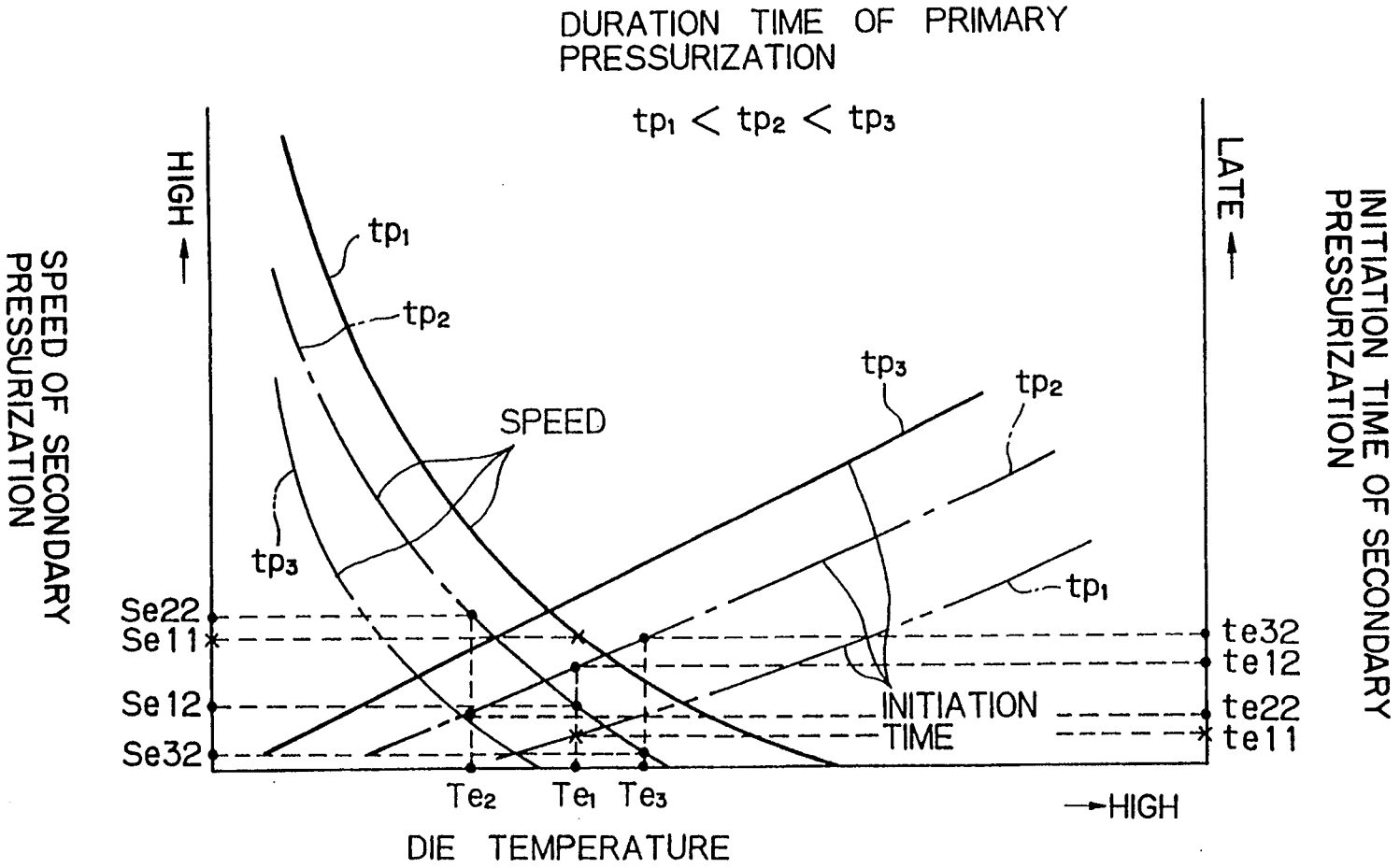
FIG. 21 is a graph showing optimum speed and initiation time of the secondary pressurization effected by a squeeze pin for preventing occurrence of a shrinkage cavity, for different duration times of the primary pressurization.

Thus, the prevention of the occurrence of the shrinkage cavity requires that the squeeze conditions, i.e., the initiation time of secondary pressurization effected by a squeeze pin 119 (squeeze timing) and the secondary pressurization speed or squeeze speed, are controlled with respect to the variation of the die temperature and primary pressurization duration time in accordance with the predetermined optimum curves for preventing the shrinkage cavity, as shown in FIG. 21.

Figure 22:
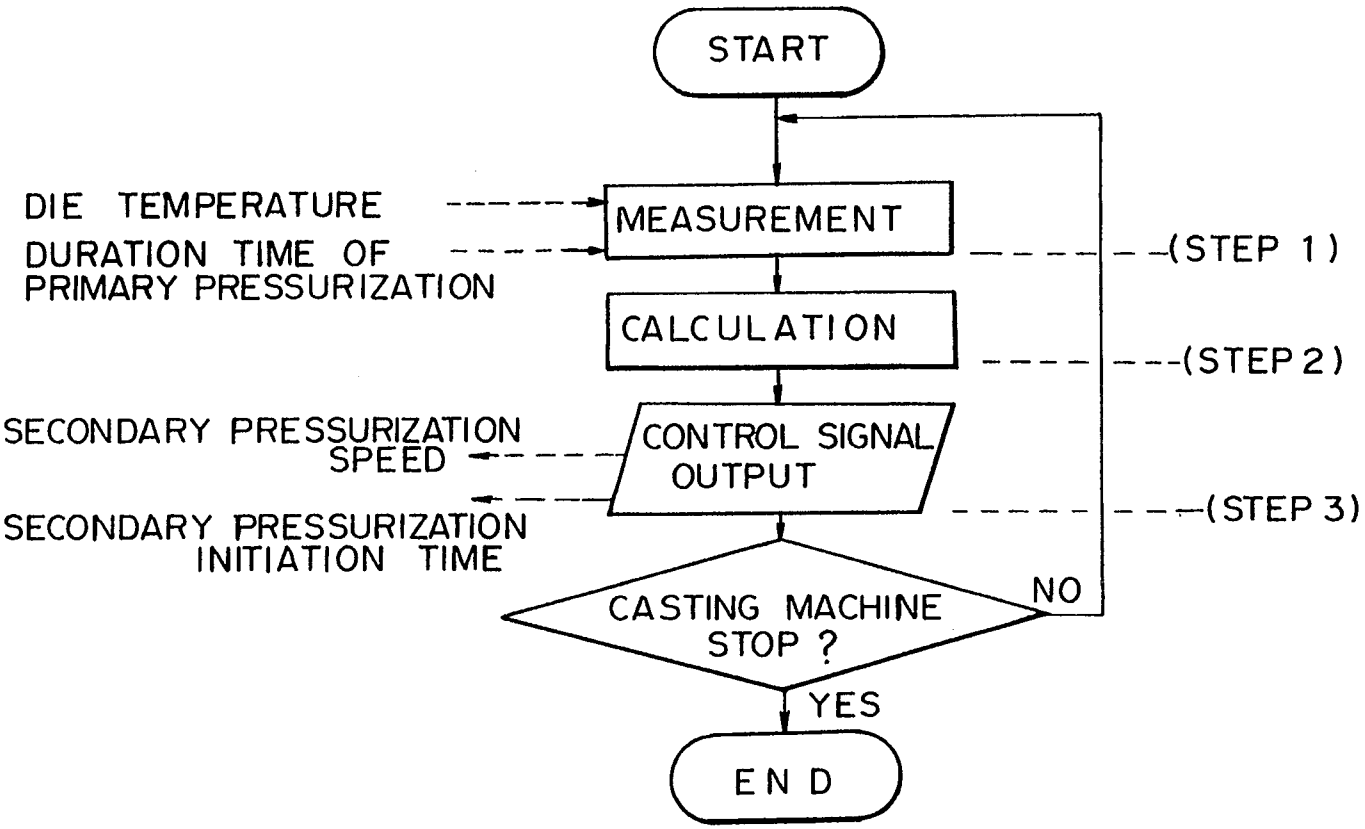
FIG. 22 is a flowchart showing a sequence of controlling the additional secondary pressurization effected by a squeeze pin.

This control is conducted by a microprocessor 129 of FIG. 12 and in the following sequence as shown in FIG. 22.

FIG. 21 shows the interrelationship obtained by calculation and experiments. This graph can be used in the following manner. A measured die temperature $T_{e1}$ and a measured primary pressurization duration time $t_{p2}$ provide a speed ($S_{e12}$) and initiation time ($t_{e12}$) of the secondary pressurization, respectively.

When the die temperature is reduced from $T_{e1}$ to $T_{e2}$ with the primary pressurization duration time of $t_{p2}$ unchanged, solidification of a molten metal in the die cavity proceeds faster, and therefore, the secondary pressurization is initiated at an earlier time of $t_{e22}$ ($>t_{e12}$) and proceeds at a greater speed of $S_{e22}$ ($>S_{e12}$), However, when the die temperature is raised from $T_{e1}$ to $T_{e3}$, the solidification proceeds slower, and therefore, the secondary pressurization is initiated at a later time of $t_{32}$ ($>t_{e12}$) and proceeds at a smaller speed of $S_{e32}$ ($<S_{e12}$).

When the primary pressurization duration time is reduced from $t_{p2}$ to $t_{p1}$ with the die temperature of $T_{e1}$ unchanged, the molten metal supply is reduced, and therefore, the secondary pressurization is initiated at an early time of $t_{e11}$ ($<t_{e12}$) and proceeds at a greater speed of $S_{e11}$ ($>S_{e12}$). However, when the primary pressurization duration time is longer, the molten metal supply is increased, and therefore, the inverse condition can be used.

Step 1

When a die-casting machine is ready to start casting, the die temperature is measured, and then, the wave profile of the primary pressurization by the injection plunger 107 is measured by a pressure sensor 117 to determine a time elapsed until the primary pressure drops as shown in FIG. 18, which is referred to as a primary pressurization duration time.

Step 2

Optimum squeeze conditions, i.e., the secondary pressurization speed and the secondary pressurization initiation time, are measured by the displacement sensor 122 of FIG. 12 in the form of a wave profile as shown in FIG. 13 and are calculated by using the thus-measured die temperature and primary pressurization duration time and based on the optimum curves of FIG. 21.

Step 3

The thus calculated values of the secondary pressurization speed and the secondary pressurization initiation time are input to the respective control systems. Namely, the secondary pressurization initiation time is controlled by the open/close signal of an electromagnetic valve 123 and the secondary pressurization speed is controlled by the aperture control signal of a flow control valve 118.

Figure 23A:
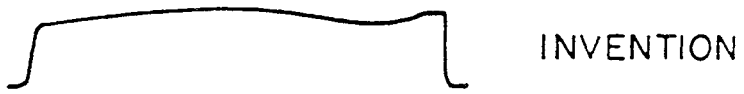
FIGS. 23(*a*) and 23(*b*) are graphs contrasting two wave profiles of the molten metal pressure in a die cavity for two samples in which the present inventive pressurization is effected (a) and not effected (b)
Figure 23B:
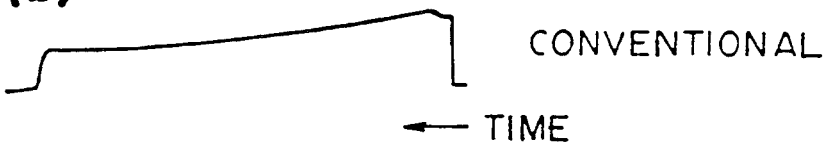

FIGS. 23(*a*) and 23(*b*) schematically show the wave profile of the molten metal pressure in a die cavity when the pressure control according to the present invention is effected (a) or not effected (b). Comparison between these two cases shows that the present invention provides a sufficient pressurization effect, because a pressure reduction during the duration of pressurization is remarkably mitigated as seen in case "a", in comparison with the conventional case "b".

As mentioned above, the secondary pressurization initiation time is calculated from the die temperature and the primary pressurization duration time, as shown in FIG. 21. In this treatment, when the primary pressurization initiation time (tp) is less than a first preset value, the secondary pressurization initiation time is determined by setting the primary pressurization initiation time to equal the first preset value. Furthermore, when the primary pressurization initiation time is greater than second preset value, the second pressurization initiation time is determined by setting the primary pressurization initiation time equal to the second preset value. When the die temperature is higher than a predetermined preset die temperature, the secondary pressurization speed is determined as a secondary pressurization speed corresponding to the predetermined preset die temperature less a predetermined value.

Figure 24:
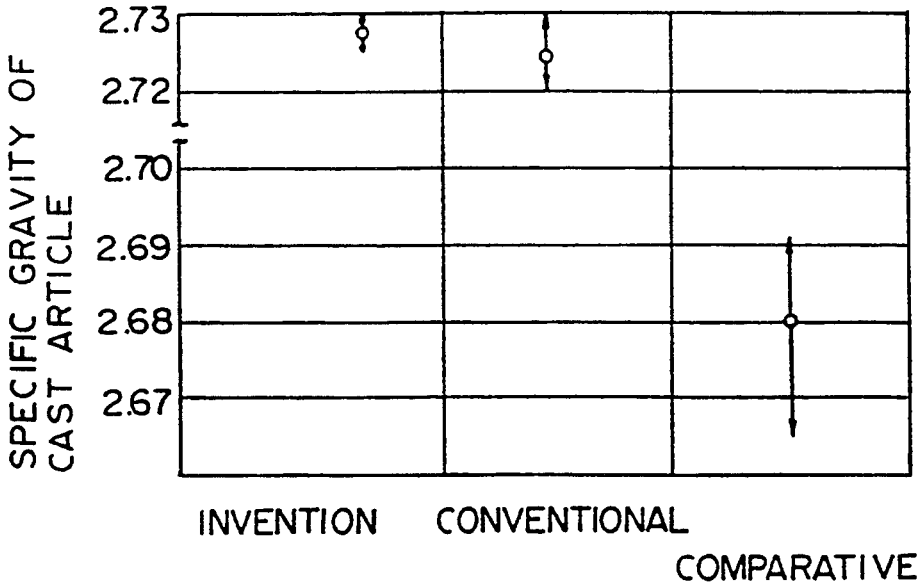
FIG. 24 is a graph showing a dispersion of the specific gravity of cast articles.

FIG. 24 shows the dispersion of the specific gravity of a cast article by way of comparison between three cases, i.e., a case in which the squeeze pressurization condition is controlled according to the present invention, a conventional case in which the squeeze pressurization is not controlled, and a comparative case in which the squeeze pressurization is not effected. In the present inventive cast article, the occurrence of the shrinkage cavity is effectively prevented, and therefore, the scattering of the specific gravity is remarkably reduced in comparison with the conventional cast article.

Another treatment in the above-mentioned embodiment according to the present invention will be described below.

Figure 27:
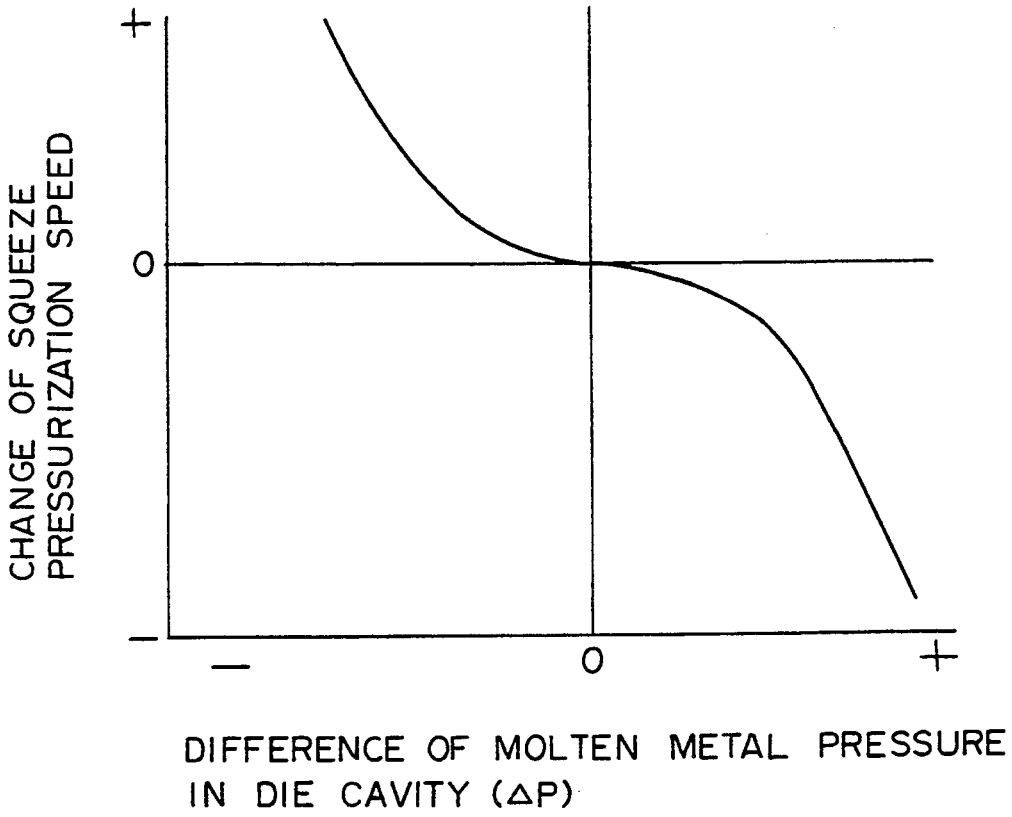
FIG. 27 is a graph showing a relationship between the pressure differential, $\Delta p$, of the average pressure in a die cavity with respect to a reference pressure and the variation of pressurization speed.

The molten metal pressure in a die cavity is measured as a wave profile such as shown in FIG. 15 and the difference ($\Delta p$) between the average pressure calculated from the measured wave profile and the average pressure for a reference wave profile such as shown in FIG. 15 is used to vary and control the pressurization speed as shown in FIG. 27. Namely, the secondary pressurization speed (i.e., the travel speed of the squeeze pin 119) is raised when the measured wave profile is smaller than the reference wave profile and the pressurization speed is lowered when the measured wave profile is larger than the reference wave profile. This provides the same effect as that obtained by the preceding embodiment of the present invention.

The pressure difference $\Delta p$ is obtained by the formula: $\Delta p$=[Reference wave profile]−[Calculated average value]. The average pressure is obtained by dividing the sum of the measured values by the number of measurements.

The discrimination of the quality of cast articles may be carried out in the following manner.

Figure 25:
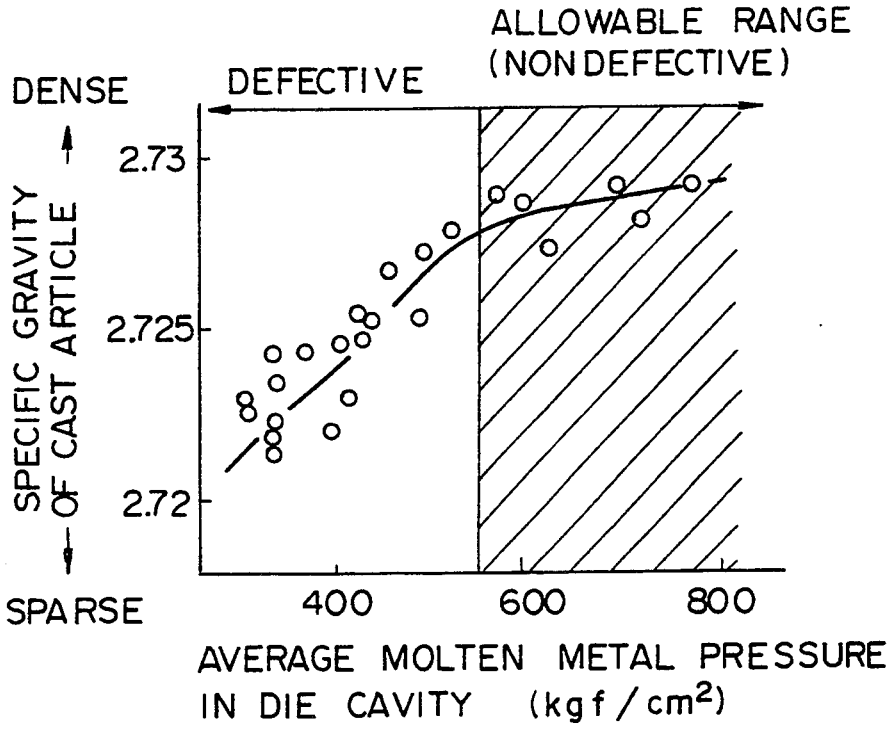
FIG. 25 is a graph showing a correlation between the average pressure in a die cavity and the quality of cast articles.
Figure 26:
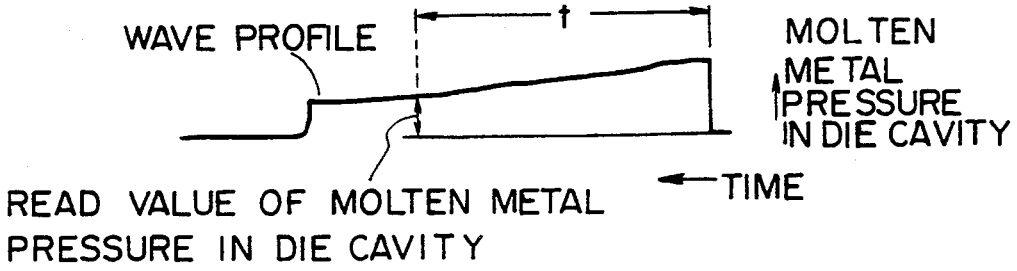
FIG. 26 is a graph showing the reading of pressure value from a wave profile of the molten metal pressure in a die cavity.

The wave profile of the molten pressure in a die cavity is measured during the entire process of one casting shot, and when the average value of the thus measured pressure in a die cavity does not satisfy a predetermined reference value, the particular cast article obtained by that casting shot is judged "defective" in a stratification. Namely, the molten metal pressure in a die cavity is measured as a wave profile such as shown in FIG. 15 and the average pressure calculated from the measured wave profile is used to discriminate the cast article quality based on the correlation shown in FIG. 25, i.e., cast articles having a quality falling within the allowable range in FIG. 25 is discriminated as "nondefective", others being discriminated as "defective". Other values readable from the measured wave profile may be used instead of the average pressure. For example, as shown in FIG. 26, a pressure value after an elapsed time "t" is detected and compared with a reference value to carry out the discrimination of the quality of cast articles. This allows a rapid and proper discrimination.

This embodiment according to the present invention particularly ensures an optimum pressurization in accordance with the variation of casting conditions, and thereby, very effectively prevents the occurrence of the shrinkage cavity and provides a cast article with required high quality.

The rapid and proper discrimination of the quality of pressure die-cast articles according to the present invention ensures a high productivity and a stable quality.

We claim:

1. A pressure die-casting process comprising the steps of:

introducing a molten metal into a die cavity of a die through an injecting port of the die;

primary-pressurizing said introduced molten metal in said die cavity with a pressure through said injecting port;

secondary-pressurizing said molten metal in said die cavity with a pressure through a pressurizing port other than said injecting port;

predetermining a relationship between a first group of operational parameters of a die temperature and a duration period of said primary pressurization and a second group of operational parameters of a initiation time and speed of said secondary pressurization, to provide an optimum relationship for preventing a shrinkage cavity of a cast product;

measuring a die temperature and a duration of said primary pressurization;

determining preset values of a secondary pressurization initiation time and a secondary pressurization speed, by using said measured values on a basis of said optimum relationship; and effecting said secondary pressurization based on said preset values of the secondary pressurization initiation time and the secondary pressurization speed.

2. The pressure die-casting process according to claim 1, wherein in the effecting said secondary pressurization step, when the primary pressurization initiation time (tp) is less than a first preset value, the secondary pressurization initiation time is determined by setting the primary pressurization initiation time to equal the first preset value; when the primary pressurization initiation time is greater than a second preset value, the second pressurization initiation time is determined by setting the primary pressurization initiation time equal to the second preset value; and, when the die temperature is higher than a preset die temperature, the secondary pressurization speed is determined as a secondary pressurization speed corresponding to the preset die temperature less a predetermined value.

3. A pressure die-casting process comprising the steps of:

introducing a molten metal into a die cavity of a die through an injecting port of the die;

primary-pressurizing said introduced molten metal in said die cavity with a pressure through said injecting port;

secondary-pressurizing said molten metal in said die cavity with a pressure through a pressurizing port other than said injecting port;

predetermining a change of a molten metal pressure in said die cavity as a function of an elapsed time, to provide a reference wave profile for preventing a shrinkage cavity of a cast product;

measuring a change of a molten metal pressure in said die cavity, to provide a measured wave profile;

comparing said measured wave profile with said reference wave profile; and setting said secondary pressurization initiation time and said secondary pressurization speed based on said comparison.

4. A pressure die-casting process according to claim 3, wherein said secondary pressurization speed is increased when said measured wave profile is smaller than said reference wave profile, and said secondary pressurization speed is decreased when said measured wave profile is larger than said reference wave profile.

5. A method of discriminating the quality of articles cast by a pressure die-casting process which comprises the steps of introducing a molten metal into a die cavity of a die through an injecting port of the die; primary-pressurizing said introduced molten metal in said die cavity with a pressure through said injecting port; and secondary-pressurizing said molten metal in said die cavity with a pressure through a pressurizing port other than said injecting port; said method of discrimination comprising the steps of:

predetermining a change of a molten metal pressure in said die cavity as a function of an elapsed time, to provide a reference wave profile for preventing a shrinkage cavity of a cast product;

measuring a change of a molten metal pressure in said die cavity, to provide a measured wave profile;

comparing said measured wave profile with said reference wave profile; and judging the quality of an article cast by said casting based on said comparison.

6. A method of discriminating the quality of die-cast articles, when casting an article by pressurizing and filling a molten metal into a die through an injection sleeve by means of an injection plunger, said method comprising the steps of:

measuring at least one of the operational parameters of a die temperature, a gas pressure in a die cavity, a molten metal pressure in the die cavity, an injection sleeve temperature, an injecting plunger travel speed, and an injection plunger displacement;

discriminating the quality of a die-cast article by comparing said measured parameter value with a reference value determined on the basis of a predetermined interrelationship between said operational parameter and a defect tolerance; and wherein the following relationship is used as said interrelationship, a relationship between the operational parameters of the die temperature, the injection sleeve temperature, the injection plunger travel speed, and the injection plunger displacement and the fraction amount of broken chilled layers.

7. A method of stratifying die-cast articles into groups, when casting an article by pressurizing and filling a molten metal into a die through an injection sleeve by means of an injection plunger, said method comprising the steps of:

measuring at least one of the operational parameters of a die temperature, a gas pressure in a die cavity, a molten metal pressure in the die cavity, an injection sleeve temperature, an injection plunger travel speed, and an injection plunger displacement;

discriminating the quality of a die-cast article by comparing said measured parameter value with a reference value determined on the basis of a predetermined interrelationship between said operational parameter and a defect tolerance, to stratify the die-cast articles into a group of nondefective articles and groups of defective articles including different kinds of defects, within the stage of casting; and wherein the following relationship is used as said interrelationship, a relationship between the operational parameters of the die temperature, the injection sleeve temperature, the injection plunger travel speed, and the injection plunger displacement and the fraction amount of broken chilled layers.

* * * * *